United States Patent [19]

Witz

[11] 4,075,684

[45] Feb. 21, 1978

[54] FOLDABLE LAMPSHADE

[75] Inventor: Sidney R. Witz, 420 N. Orange Drive, Los Angeles, Calif. 90036

[73] Assignee: Sidney R. Witz, Los Angeles, Calif.

[21] Appl. No.: 734,334

[22] Filed: Oct. 20, 1976

[51] Int. Cl.[2] ..... F21V 1/00

[52] U.S. Cl. ..... 362/352

[58] Field of Search ..... 240/108 R, 108 D, 108 B, 240/108 A, 136, 145

[56] References Cited

U.S. PATENT DOCUMENTS

| | | | |
|---|---|---|---|
| 2,884,515 | 4/1959 | Fogel | 240/136 X |
| 3,023,307 | 2/1962 | Okamoto | 240/145 X |
| 3,142,446 | 7/1964 | Okamoto | 240/136 X |
| 3,155,349 | 11/1964 | Derman et al. | 240/145 |
| 3,180,982 | 4/1965 | Derman et al. | 240/108 A X |
| 3,435,205 | 3/1969 | Paul | 240/108 D |
| 3,764,801 | 10/1973 | Mainieks | 240/108 D |
| 3,787,676 | 1/1974 | Korach | 240/108 R |

*Primary Examiner*—Richard L. Moses
*Attorney, Agent, or Firm*—Ralph B. Pastoriza

[57] ABSTRACT

The lampshade includes flexible material which can be unrolled to form a relatively large cylindrical shade. Upper and lower hoops are formed of flexible strip material by unspiralling the strip material and connecting its ends together thus holding the upper and lower interior portions of the shade in circular positions. A spider assembly is made up of three elongated flat arms pivoted together and arranged to be scissored apart to radially extend at 120°. The ends of these arms cradle portions of the upper hoop on the interior of the shade to provide a central mount for securing the shade to a lamp.

3 Claims, 8 Drawing Figures

FOLDABLE LAMPSHADE

This invention relates to lampshades and more particularly to an improved foldable lampshade which may be easily disassembled and formed into compact components for ease in storing or shipping.

BACKGROUND OF THE INVENTION

Most lampshades are relatively large and of cylindrical or conical configuration and occupy substantial room even though the total quantity of material making up the shade is relatively little and the material itself relatively light.

The foregoing presents a problem when shipment of lampshades are made from a manufacturing facility to wholesalers or retailers. Packaging of the lampshades after they have been manufactured without damaging the same represents a real problem in time and expense as well as in shipping costs. Moreover, a wholesaler or retailer has a storage problem for received lampshades which are not actually on display in the store.

Many attempts have been made in the past to solve the foregoing problem by providing a knock-down lampshade or foldable type lampshade which can be shipped for relatively little expense and occupies relatively small areas and wherein the receiver such as a wholesaler or retailer can then reassemble the lampshade for display in the store. However, in spite of several known types of foldable or knock-down lampshades, very few have ever been commercially successful.

BRIEF DESCRIPTION OF THE PRESENT INVENTION

Bearing the foregoing in mind, the present invention contemplates the provision of an improved foldable lampshade which may be assembled from its basic components, these basic components in turn being "foldable" or rollable into relatively small sizes for ease in shipment and/or storage.

Briefly, the foldable lampshade contemplates the provision of flexible material arranged to be formed into a surface of revolution defining a shade. Upper and lower flexible strips in turn are arranged to be formed into upper and lower hoops receivable within the upper and lower interior portions of the shade to hold the upper and lower shade portions in circular positions. The foldable lampshade is completed by the provision of a spider means including at least two flat arms pivoted together at first ends so that the arms can be folded together or scissored to extend radially outwardly. The extending ends terminate in cradle portions for engaging the upper flexible strip or hoop at circumferentially spaced points to thereby provide a central mount for securing the shade to a lamp.

With the foregoing arrangement, the flexible material making up the shade itself can be rolled up into a small diameter configuration. The upper and lower hoops in the form of the flexible strips in turn can be formed into tight spirals to occupy very little space while the spider assembly can have its arms scissored together in overlying relationship and thus be easily packaged.

The construction of the components is such that they can be readily designed for fluted type shades or pleated shades, cylindrical or drum shaped shades or conically shaped shades.

BRIEF DESCRIPTION OF THE DRAWINGS

A better understanding of this invention will be had by referring to the accompanying drawings in which.

DETAILED DESCRIPTION OF THE INVENTION

Figure 1:
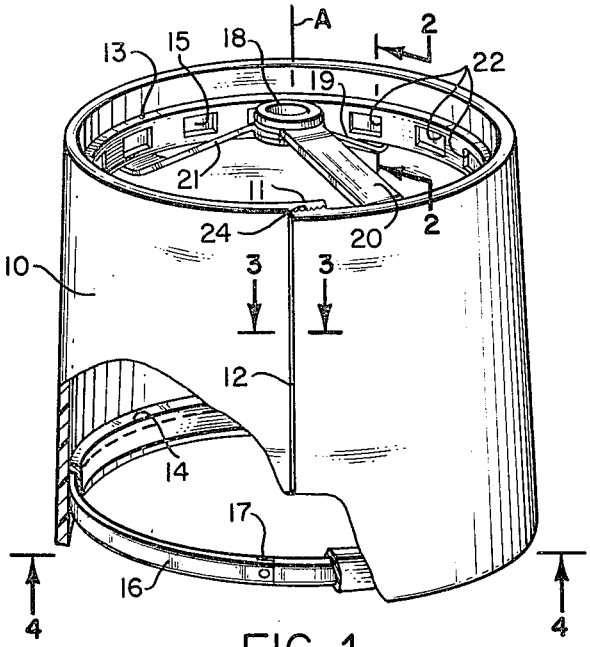
FIG. 1 is a broken away perspective view of a foldable lampshade in assembled relationship in accord with the present invention.

Referring to FIG. 1, the foldable lampshade includes a flexible material 10 capable of being rolled up into a cylindrical shape of relatively small diameter and unrolled into a relatively large cylindrical shape defining a shade as illustrated in FIG. 1. The ends of the flexible material when unrolled into the large cylindrical shade as shown are arranged to overlap as at 11 and 12, any suitable adhesive means being provided for holding the ends in overlapped relationship.

Also illustrated in FIG. 1 are upper and lower interior flexible channel means 13 and 14 annularly extending about the inside surface of the shade 10. The channel means as illustrated in FIG. 1 lie in upper and lower parallel planes normal to the axis A of the shade.

Cooperating with the channel means are upper and lower flexible strips 15 and 16 each arranged to be coiled into a tight spiral and uncoiled into a circle of diameter corresponding to the upper and lower interior diameters of the shade. These flexible strips are respectively receivable in the upper and lower channel means 13 and 14 prior to actually forming the flexible material 10 into the large cylindrical shape illustrated. In this respect, each of the flexible strips is arranged to have its ends secured together as by an appropriate snap means such as indicated at 17 for the lower strip 16.

Preferably, the flexible strips 15 and 16 within the upper and lower channels 13 and 14 are of thin metal and function as upper and lower circular hoops to hold the flexible shaped material 10 in the large cylindrical configuration.

The structure is completed by the provision of a spider assembly including a central ring 18 pivotally holding the ends of at least two and preferably three elongated flat arm members 19, 20 and 21 in such a manner that the arm members may be scissored apart to radially extend from the pivot point. In the particular embodiment illustrated in FIG. 1, the extending ends of the flat arms terminate in upturned portions arranged to cradle the upper flexible strip 15 at circumferentially spaced points. Towards this end, there are provided a series of windows or cut-outs 22 evenly spaced in the upper channel means 13, selected ones of these windows receiving the extending ends of the spider arms.

Figure 2:
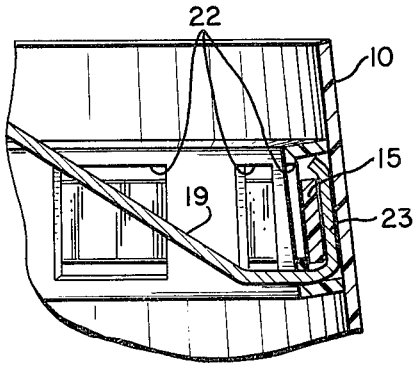
FIG. 2 is an enlarged fragmentary cross section taken in the direction of the arrows 2—2 of FIG. 1.

Referring specifically to the enlarged cross section of FIG. 2, the foregoing is illustrated in greater detail wherein the upturned end of the spider arm 19 is illustrated at 23 passing through the window 22 and cradling the upper flexible band or strip 15. Where three arms are provided on the spider as described, they will extend at 120° to each other so that the selected windows 22 are circumferentially spaced at 120°. The spider provides a central mount for securing the shade to a lamp.

Figure 3:
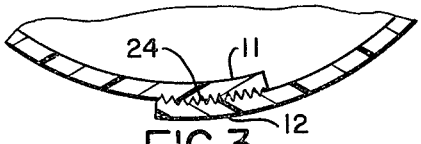
FIG. 3 is another fragmentary cross section taken in the direction of the arrows 3—3 of FIG. 1.

FIG. 3 shows a preferred means for securing together the overlapping ends of the shade material 10 itself. In this respect, the opposing overlapped surfaces of the ends 11 and 12 of the flexible material making up the shade are provided with Velcro 24 so that it is a simple matter to press the overlapping portions together to effect an adhesive or holding action.

Figure 4:
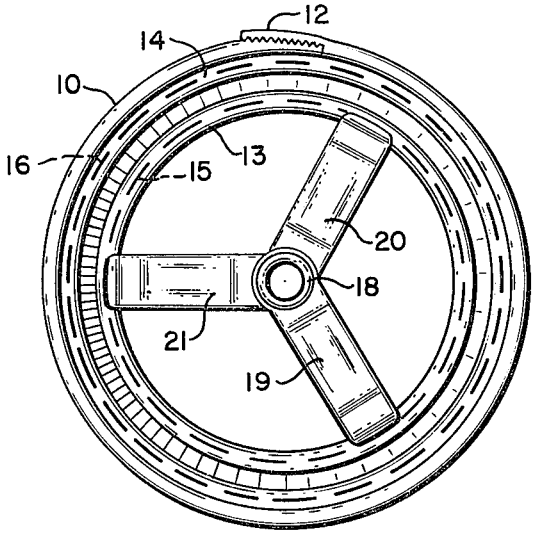
FIG. 4 is a bottom plan view looking upwardly through the shade of FIG. 1 in the direction of the arrows 4—4.

In the underside view of FIG. 4, the arms 19, 20 and 21 of the spider structure extending at 120° will be evident. In FIG. 4, the upper and lower channels are again indicated at 13 and 14 and the upper and lower flexible strips forming hoops indicated by the dashed lines 15 and 16 respectively, it being understood that these strips are received in the channels.

Figure 5:
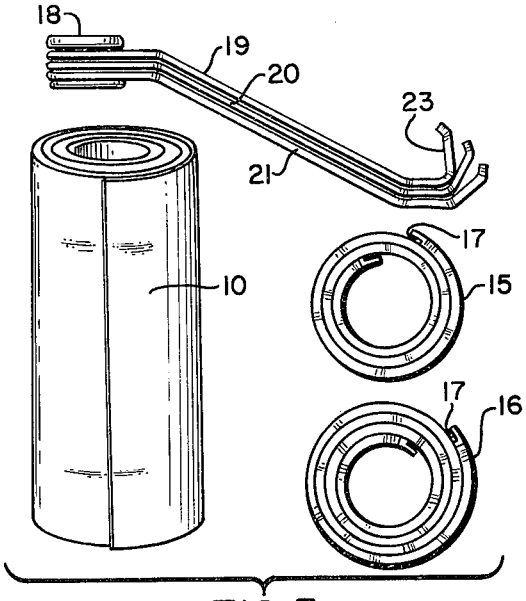
FIG. 5 illustrates full views of the various components making up the shade of FIG. 1 in folded or compact form for shipping or storage.

FIG. 5 illustrates the various components making up the assembled shade of FIG. 1 when in "folded" or rolled up condition for ease in shipment or storage. Thus, the flexible material 10 is shown rolled into a cylinder of relatively small diameter compared to that of the shade as shown in FIG. 1. The upper and lower flexible strips 15 and 16 described in FIG. 1, in turn, are spiralled into small configurations as illustrated while the spider structure is effectively folded by swinging the three radially extending arms into positions overlying one another about the pivot 18 as shown. The elongated flat arms 19, 20 and 21 themselves are relatively stiff but of sufficient flexibility to permit the overlying arrangement illustrated in FIG. 5, the upturned end portions such as 23 described for the arm 19 flexing to accommodate the positions of the others as shown.

Figure 6:
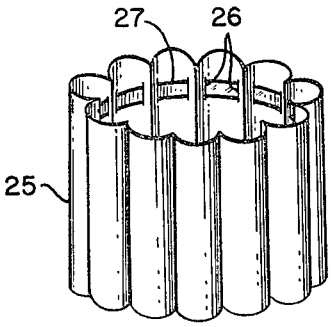
FIG. 6 is a perspective view of a fluted shade material.

FIG. 6 illustrates a fluted shade material 25 which can also be rolled up into a smaller diameter configuration without destroying the flutes by simply internesting the same. Because of the relatively sharp inturned vertices of the flutes at the interior of the shade, the channel means can be defined by slots 26 passing through these vertices for receiving an upper flexible strip as shown at 27. Similar slots and a similar strip structure would be provided on the interior lower portion of the fluted shade.

Figure 7:
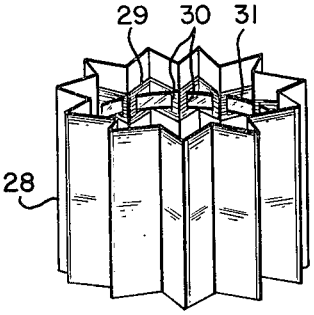
FIG. 7 is a perspective view of a pleated shade material.

In the event a pleated type shade material is utilized such as indicated in FIG. 7, the shade itself can be collapsed in accordion fashion. However, because the vertex angle is fairly wide for the pleated shade, it is not feasible simply to slot the inwardly directed vertices for receiving an upper flexible strip since the strip itself would be visible from the exterior of the shade. Accordingly in accord with the embodiment shown in FIG. 7, there is provided additional pleated material indicated at 29 provided with slots 30 for receiving a flexible strip 31.

Figure 8:
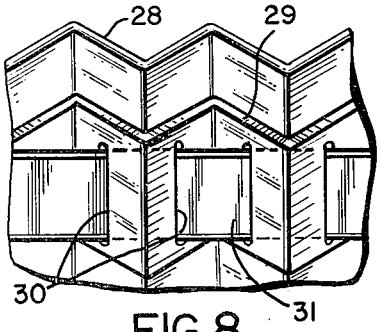
FIG. 8 is an enlarged fragmentary perspective view of a portion of the pleated shade of FIG. 7.

The foregoing construction is more clearly illustrated in the enlarged fragmentary view of FIG. 8 wherein the additional material 29 is shown with the slots 30 receiving the strip 31. This additional material can simply be glued or otherwise permanently affixed to the upper interior main pleat portions of the shade 28.

In both types of shades illustrated in FIGS. 6 and 7, a spider assembly similar to that described for the shade of FIGS. 1 through 5 may be used. Further, while not illustrated in FIGS. 6 and 7, it will be understood that the shade material can be provided with overlapping ends at any convenient circumferential location with an appropriate adhesive material to affix the same together. Maintaining the desired final cylindrical shape is realized by the provision of the flexible strips formed into circular configurations or "hoop" structures as described with respect to FIG. 1.

From the foregoing description, it can be appreciated that the present invention has provided a very simple and easy to assemble, foldable lampshade so designed as to enable various different shade styles to be folded into compact configurations. Essentially, the lampshade consists of only four separable items: first, the shade material itself which can normally be rolled up into a tight configuration or collapsed into an accordion type configuration in the case of pleated material; second, an upper tightly spiralled flexible band which can be enlarged into a circular configuration with its ends snapped together for holding the upper interior portion of the shade material in its circular shape; third, a lower flexible band tightly spiralled which in the case of a conical shape shade would be somewhat longer and thus contain more spirals which again can be formed into a larger diameter circle with its ends snapped together to position the lower interior portion of the shade in a circular configuration; and four, a foldable spider assembly such as indicated in FIG. 5 wherein the radially extending arms can be pivotally swung into overlying relationship as described.

In use, the lampshade would be manufactured with its corresponding parts and shipped to a wholesaler or retailer in the collapsed state such as illustrated by way of example in FIG. 5. The receiving wholesaler or retailer could then only assemble those particular shades which he wished to display and keep the others in their folded or compact configurations for economy in storage space.

It should also be understood that the provision of the foldable lampshade as described renders it very easy to fill mail orders directly from consumers for lampshades. The consumer himself can readily assemble the shade without the need of any special tools or the like particularly when the adhesive arrangement constitutes Velcro or similar material for the shade.

While channel means have been described for the particular embodiments illustrated, it should be understood that in the case of a conically shaped shade wherein the diameter of the lower interior portion of the shade is greater than the upper interior portion, it is possible to simply wedge in the upper and lower flexible strips when in circular shapes whereby the same will be held by friction, the spider structure then cradling circumferentially spaced portions of the upper strip to serve as a central mount for securing the shade to a lamp. In this latter type construction, an even simpler arrangement results there being avoided the necessity of any type of channel means.

I claim:

1. A foldable lampshade comprising, in combination:

(a) flexible material capable of being rolled up into a cylindrical shape of relatively small diameter and unrolled into a relatively large cylindrical shape defining a shade with its ends in overlapping relationship;

(b) upper and lower interior flexible channel means about the inside surface of said shade, said channel means lying in upper and lower parallel planes normal to the axis of said shade;

(c) upper and lower flat flexible strips arranged to be coiled into tight spirals and uncoiled into circles of diameters corresponding to the upper and lower interior diameters of said shade, respectively, and receivable in said upper and lower channel means, respectively, the ends of the flexible strips including snap means for connecting the same together to hold the upper and lower interior portions of the shade in circular shapes; and, (d) a spider assembly including three elongated flat arm members, one above the other when in closed position, and pivoted at adjacent ends such that the arms may be scissored to an open position wherein they radially extend from the point of pivoting, the extending ends of said arms terminating in upturned portions dimensioned to cradle the upper flexible strip at circumferentially spaced points at 120° to provide a central mount for securing the shade to a lamp, said upper channel means including a series of evenly spaced cut-out windows selected ones of which circumferentially spaced at 120° receive the extending ends of said arms making up said spider assembly whereby the lampshade can be disassembled and its components folded into compact configurations for storage or shipping.

2. A foldable lampshade comprising, in combination:

(a) flexible material capable of being rolled up into a cylindrical shape of relatively small diameter and unrolled into a relatively large cylindrical shape defining a shade with its ends in overlapping relationship;

(b) upper and lower interior flexible channel means about the inside surface of said shade, said channel means lying in upper and lower parallel planes normal to the axis of said shade;

(c) upper and lower flat flexible strips arranged to be coiled into tight spirals and uncoiled into circles of diameters corresponding to the upper and lower interior diameters of said shade, respectively, and receivable in said upper and lower channel means, respectively, the ends of the flexible strips including snap means for connecting the same together to hold the upper and lower interior portions of the shade in circular shapes; and, (d) a spider assembly including three elongated flat arm members, one above the other when in closed position, and pivoted at adjacent ends such that the arms may be scissored to an open position wherein they radially extend from the point of pivoting, the extending ends of said arms terminating in upturned portions dimensioned to cradle the upper flexible strip at circumferentially spaced points at 120° to provide a central mount for securing the shade to a lamp, said flexible material being fluted, said channel means being defined by slots in the inwardly directed vertices of the flutes whereby the lampshade can be disassembled and its components folded into compact configurations for storage or shipping.

3. A foldable lampshade comprising, in combination:

(a) flexible material capable of being rolled up into a cylindrical shape of relatively small diameter and unrolled into a relatively large cylindrical shape defining a shade with its ends in overlapping relationship;

(b) upper and lower interior flexible channel means about the inside surface of said shade, said channel means lying in upper and lower parallel planes normal to the axis of said shade;

(c) upper and lower flat flexible strips arranged to be coiled into tight spirals and uncoiled into circles of diameters corresponding to the upper and lower interior diameters of said shade, respectively, and receivable in said upper and lower channel means, respectively, the ends of the flexible strips including snap means for connecting the same together to hold the upper and lower interior portions of the shade in circular shapes; and, (d) a spider assembly including three elongated flat arm members, one above the other when in closed position, and pivoted at adjacent ends such that the arms may be scissored to an open position wherein they radially extend from the point of pivoting, the extending ends of said arms terminating in upturned portions dimensioned to cradle the upper flexible strip at circumferentially spaced points at 120° to provide a central mount for securing the shade to a lamp, said flexible material being pleated, said channel means being defined by additional pleated material internally secured to the flexible material and having slots in their inwardly directed vertices for receiving the flexible strips whereby the lampshade can be disassembled and its components folded into compact configurations for storage or shipping.

* * * * *